US005341160A

United States Patent [19]

Winslow et al.

[11] Patent Number: 5,341,160

[45] Date of Patent: Aug. 23, 1994

[54] VALVE FOR INK-JET PEN

[75] Inventors: Thomas H. Winslow; Paul H. McClelland, both of Corvallis; Donald E. Wenzel, Albany, all of Oreg.

[73] Assignee: Hewlett-Packard Corporation, Palo Alto, Calif.

[21] Appl. No.: 687,549

[22] Filed: Apr. 17, 1991

[51] Int. Cl.[5] ..... B41J 2/055

[52] U.S. Cl. ..... 347/86; 137/43; 137/251.1

[58] Field of Search ..... 346/140 R; 137/43, 251.1; 222/188

[56] References Cited

U.S. PATENT DOCUMENTS

| | | | |
|---|---|---|---|
| 3,026,903 | 3/1962 | Roach . | |
| 3,946,398 | 3/1976 | Kyser et al. . | |
| 4,149,172 | 4/1979 | Heinzl et al. . | |
| 4,245,617 | 1/1981 | Buckley . | |
| 4,253,489 | 3/1981 | Schleiter, Sr. . | |
| 4,272,773 | 6/1981 | Halasz . | |
| 4,342,042 | 7/1982 | Cruz-Uribe et al. . | |
| 4,412,232 | 10/1983 | Weber et al. . | |
| 4,422,084 | 12/1983 | Saito . | |
| 4,500,895 | 2/1985 | Buck et al. . | |
| 4,503,443 | 3/1985 | Dagna . | |
| 4,509,062 | 4/1985 | Low et al. . | |
| 4,571,599 | 2/1986 | Rezanka . | |
| 4,673,955 | 6/1987 | Ameyama et al. . | |
| 4,677,447 | 6/1987 | Nielsen . | |
| 4,712,172 | 12/1987 | Kiyohara et al. . | |
| 4,714,937 | 12/1987 | Kaplinsky . | |
| 4,716,920 | 1/1988 | Crute | 137/43 X . |
| 4,771,295 | 9/1988 | Baker et al. . | |
| 4,785,314 | 11/1988 | Terasawa et al. . | |
| 4,791,438 | 12/1988 | Hanson et al. . | |
| 4,794,409 | 12/1988 | Cowger et al. . | |
| 4,920,362 | 4/1990 | Cowger et al. . | |
| 4,929,969 | 5/1990 | Morris . | |
| 4,961,076 | 10/1990 | Cowger | 346/140 R |
| 4,992,802 | 2/1991 | Dion et al. . | |

FOREIGN PATENT DOCUMENTS

| | | |
|---|---|---|
| 3003047 | 10/1980 | Fed. Rep. of Germany . |
| 56-92072 | 7/1981 | Japan . |
| 59-232872 | 12/1984 | Japan . |
| 56868 | 2/1969 | Poland . |

OTHER PUBLICATIONS

"Ink Retention in a Color Thermal Inkjet Pen," Hewlett Packard Journal, Aug., 1988, pp. 41–44, Erol Erturk, et al.

*Primary Examiner*—Benjamin R. Fuller
*Assistant Examiner*—J. E. Barlow, Jr.

[57] ABSTRACT

An ink-jet pen for storing at below-ambient pressure has an orifice formed therein for providing air bubbles to prevent the back pressure from rising above a level that would cause malfunction of the pen. The amount of air drawn into the reservoir is restricted by the reservoir ink that covers the orifice whenever the pen is in an upright position. The valve operates to occlude the orifice whenever the pen is moved into a position, such as inverted, where the reservoir ink no longer covers the orifice. The occlusion of the orifice prevents the unrestricted flow of ambient air into the reservoir that would otherwise eliminate the required back pressure in the reservoir. The valve includes a sealing liquid selected so that the liquid occludes a passage between the orifice and ambient air without flowing through that passage.

24 Claims, 5 Drawing Sheets

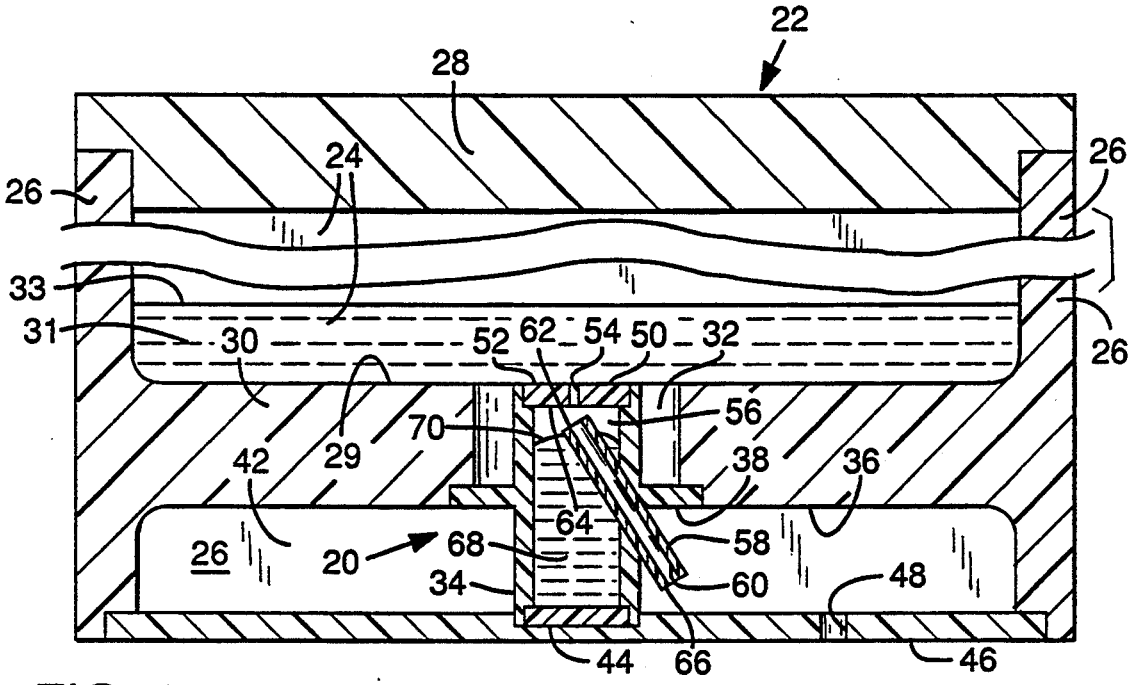
FIG. 1
FIG. 2
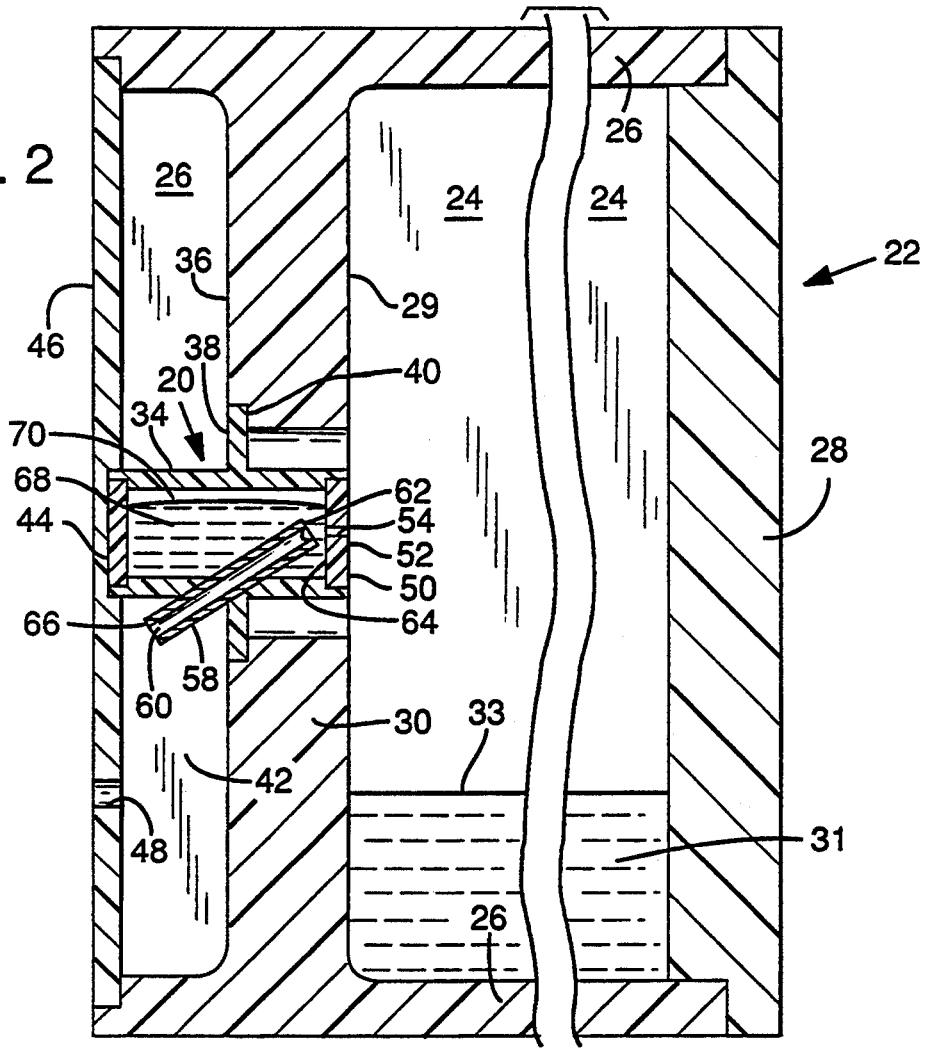

VALVE FOR INK-JET PEN

TECHNICAL FIELD

This invention pertains to a valve used as part of an ink supply system for an ink-jet pen.

BACKGROUND INFORMATION

Ink-jet printing generally involves the controlled delivery of ink drops from an ink-jet pen reservoir to a printing surface. One type of ink-jet printing, known as drop-on-demand printing, employs a pen that includes a print head and ink reservoir. The print head is responsive to control signals for ejecting drops of ink from the ink reservoir.

Drop-on-demand type print heads typically use one of two mechanisms for ejecting drops: thermal bubble or piezoelectric pressure wave. A thermal bubble type print head includes a thin-film resistor that is heated to cause sudden vaporization of a small portion of the ink solvent. The rapid expansion of the ink vapor forces a small amount of ink through a print head orifice.

Piezoelectric pressure wave type print heads use a piezoelectric element that is responsive to a control signal for abruptly compressing a volume of ink in the print head to produce a pressure wave that forces the ink drops through the orifice.

Although conventional drop-on-demand print heads are effective for ejecting or "pumping" ink drops from a pen reservoir, they do not include any mechanism for preventing ink from permeating through the print head when the print head is inactive. Accordingly, drop-on-demand techniques require the fluid in the ink reservoir to be stored in a manner that provides a slight back pressure at the print head to prevent ink leakage from the pen whenever the print head is inactive. As used herein, the term "back pressure" means the partial vacuum within the pen reservoir that resists the flow of ink through the print head. Back pressure is considered in the positive sense so that an increase in back pressure represents an increase in the partial vacuum. Accordingly, back pressure is measured in positive terms, such as centimeter (cm) of water column height.

The back pressure at the print head must be at all times strong enough for preventing ink leakage. The back pressure, however, must not be so strong that the print head is unable to overcome the back pressure to eject ink drops. Moreover, the ink-jet pen must be designed to operate despite environmental changes that cause fluctuations in the back pressure.

A severe environmental change that affects reservoir back pressure occurs during air transport of an ink-jet pen. In this instance, ambient air pressure decreases as the aircraft gains altitude and is depressurized. As ambient air pressure decreases, a correspondingly greater amount of back pressure is needed to keep ink from leaking through the print head. Accordingly, the level of back pressure within the pen must be regulated during times of ambient pressure drop.

The back pressure within an ink-jet pen reservoir is also subjected to what may be termed "operational effects." One significant operational effect occurs as the print head is activated to eject ink drops. The consequent depletion of ink from the reservoir increases (makes more negative) the reservoir back pressure. Without regulation of this back pressure increase, the ink-jet pen will eventually fail because the print head will be unable to overcome the increased back pressure to eject ink drops. Such failure wastes ink whenever the failure occurs before all of the useable ink within the reservoir has been ejected.

Past efforts to regulate ink-jet reservoir back pressure in response to environmental changes and operational effects have included mechanisms that may be collectively referred to as accumulators. Examples of accumulators are described in U.S. patent application Ser. No. 07/289,876, entitled METHOD AND APPARATUS FOR EXTENDING THE ENVIRONMENTAL RANGE OF AN INK JET PRINT CARTRIDGE.

Generally, prior accumulators comprise a movable cup-like mechanism that defines an accumulator volume that is in fluid communication with the ink-jet pen reservoir volume. The accumulators are designed to move between a minimum volume position and a maximum volume position in response to changes in the level of the back pressure within the reservoir. Accumulator movement changes the overall volume of the reservoir to regulate back pressure level changes so that the back pressure remains within an operating range that is suitable for preventing ink leakage while permitting the print head to continue ejecting ink drops.

For example, as the difference between ambient pressure and the back pressure within the pen decreases as a result of ambient air pressure drop, the accumulator moves to increase the reservoir volume, thereby to increase the back pressure to a level (within the operating range mentioned above) that prevents ink leakage. Put another way, the increased volume attributable to accumulator movement prevents a reduction in the difference between ambient air pressure and back pressure that would otherwise occur if the reservoir were constrained to a fixed volume as ambient air pressure decreased.

Accumulators also move to decrease the reservoir volume whenever environmental changes or operational effects (for example, ink depletion occurring during operation of the pen) cause an increase in the back pressure. The decreased volume attributable to accumulator movement reduces the back pressure to a level within the operating range, thereby permitting the print head to continue ejecting ink.

Accumulators are usually equipped with internal or external resilient mechanisms that continuously urge the accumulators toward a position for increasing the volume of the reservoir. The effect of the resilient mechanisms is to retain a sufficient minimum back pressure within the reservoir (to prevent ink leakage) even as the accumulator moves to increase or decrease the reservoir volume.

Past accumulators have been used in conjunction with devices known as bubble generators. Bubble generators permit ambient air bubbles to enter the ink reservoir once the accumulator has moved to its minimum volume position (that is, once the accumulator is unable to further reduce the back pressure within the reservoir) and the back pressure continues to rise as the print head continues to eject ink from the reservoir. The effect of the air bubbles delivered by the bubble generator is to keep the reservoir back pressure from increasing to a level that would cause failure of the print head.

Bubble generators generally comprise a small-diameter orifice that provides fluid communication between the pen reservoir and ambient air. The bubble generator orifice is small enough, and the ink surface tension is great enough, to counteract the gravitational and static pressure forces that would otherwise cause ink to leak through the bubble generator orifice. Moreover, because the reservoir ink normally covers the reservoir-end of the bubble generator orifice, ambient air is restricted from entering the reservoir until the back pressure increases to a level great enough for drawing an air bubble through the reservoir ink covering the orifice.

One problem with the use of bubble generators arises whenever the pen is moved to a position where the reservoir ink no longer covers the orifice to restrict the inflow of ambient air. As a result, the consequent unrestricted inflow of ambient air eliminates the back pressure, thereby causing ink leakage and malfunction of the print head.

SUMMARY OF THE INVENTION

This invention is directed to a valve that effectively occludes the bubble generator orifice whenever the pen is moved (for example, inverted) to a position where reservoir ink no longer covers the orifice.

The valve is used in association with a bubble generator orifice in an ink-jet pen reservoir, which orifice is normally covered with the reservoir ink while the pen is in an upright position. The valve includes a basin that is connected to the container and located near the orifice. The basin is nearly completely filled with a sealing liquid that is immiscible with the ink, and does not emulsify with the ink. The sealing liquid has a sufficient surface tension, viscosity, density, or a combination of those properties, for occluding the orifice whenever the pen is inverted or tipped substantially out of the upright position.

The basin and sealing liquid are arranged to define a narrow vent passage for providing fluid communication between ambient air and the bubble generator orifice whenever the pen is in the upright position. The sealing liquid occludes both the orifice and the vent passage when the pen is tipped out of the upright position.

The sealing liquid is selected and the passage is shaped so that the sealing liquid will occlude but not flow out of the passage, irrespective of the pen orientation.

BRIEF DESCRIPTION OF THE DRAWINGS

FIG. 1 is a side elevation view of an ink-jet pen that includes a valve of the present invention, the pen being in an upright position.

FIG. 2 depicts the pen and valve of FIG. 1 showing the valve operation when the pen is placed on its side.

DETAILED DESCRIPTION

Figure 3:
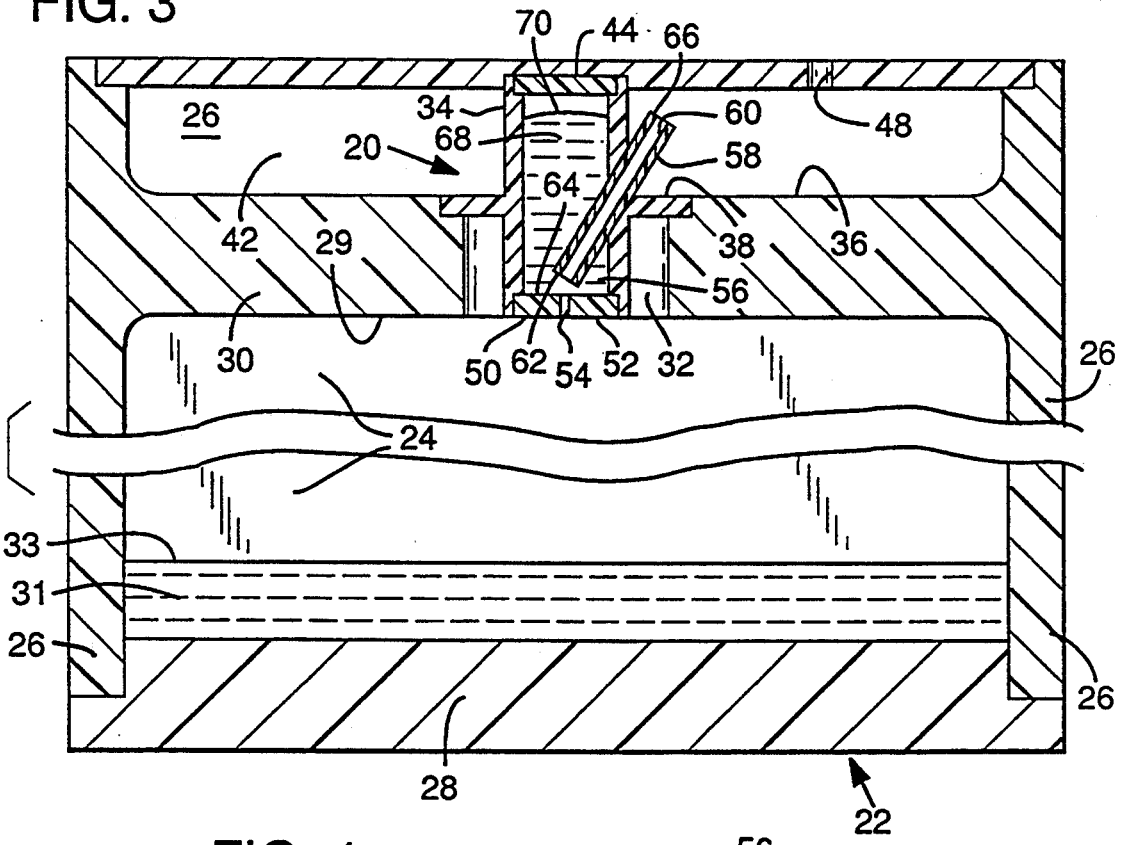
FIG. 3 depicts the pen and valve of FIG. 1 in an inverted position.

Referring to FIGS. 1–4, a preferred valve 20 of the present invention is connected to a conventional ink-jet pen 22. The pen 22 is formed of material such as plastic and includes an ink-containing reservoir 24 that is defined by side walls 26, a top 28, and a base 30. Ink 31 in the reservoir 24 completely covers the upper surface 29 of the base 30 whenever the pen 22 is in the upright position as shown in FIG. 1.

A print head (not shown) is mounted to the pen 22 and is responsive to control signals for ejecting ink drops from the reservoir 24. As reservoir ink 31 is depleted, the upper surface 33 of the ink approaches the base 30.

The base 30 of the pen 22 includes a central opening 32 into which extends the valve 20, which valve is mounted to the base 30. The valve 20 is formed of a plastic, such as polysulfone, and includes a generally cylindrical, elongated, hollow basin 34. A flange 38 protrudes outwardly from the mid-portion of the basin 34. The peripheral edge of the flange 38 is fastened, such as by heat welding, into an annular recess 40 formed in the underside 36 of the base around the opening 32.

The portion of the valve basin 34 beneath the flange 38 extends through an open vent space 42, and the bottom 44 of the basin 34 is fastened to a bottom plate 46 that extends between the bottom of the pen side walls 26. An aperture 48 is formed through the bottom plate 46 to provide fluid communication between the vent space 42 and ambient air so that the vent space 42 remains at ambient pressure.

The top 50 of the valve basin 34 includes an outer surface 52 that is coplaner with the upper surface 29 of the base 30. A bubble generator orifice 54 extends through the top of the basin 34 to provide fluid communication between the pen reservoir 24 and the interior chamber 56 that is defined by the valve basin 34. Preferably, the bubble generator orifice 54 is between 0.20 millimeter (mm) and 0.30 mm in diameter.

A vent tube 58 having an internal passage 60 is mounted to the basin 34. The vent tube 58 is oriented so that its inner end 62 resides inside the chamber 56 immediately beneath the inner surface 64 of the basin top 50, adjacent to the orifice 54. The outer end 66 of the vent tube 58 is disposed within the vent space 42.

The basin chamber 56 is nearly completely filled with the sealing liquid 68. As described more fully below, the sealing liquid has a sufficient density, surface tension, or viscosity, or combination of density, surface tension and viscosity, for occluding the passage 60 in the vent tube 58, without flowing out of the passage 60, irrespective of orientation of the pen.

The pen 22 is normally operated in the upright position shown in FIG. 1. In the upright position, the upper surface 70 of the sealing liquid 68 is just beneath the inner end 62 of the vent tube 58. As a result, passage 60 is completely open through the tube 58 to provide a fluid path between the chamber 56 and vent space 42.

As the back pressure within the reservoir 24 increases to a level approaching the maximum allowable back pressure in the reservoir 24 (the maximum allowable level being the level above which the print head is unable to overcome the back pressure to eject ink from the reservoir) the back pressure becomes great enough to draw air from the vent space 42, through the passage 60, into the chamber 56, and into the reservoir through the reservoir ink 31 that covers the orifice 54. As air bubbles enter the reservoir 24, the back pressure is slightly reduced to remain within acceptable levels for pen performance.

With reference to FIGS. 1 and 2, the sealing liquid 68 acts as a blocking valve to prevent ambient air from passing into the reservoir 24 whenever the pen 22 is tipped such that the reservoir ink 31 flows to uncover the outer surface 52 of the basin top 50 (FIG. 2). For example, in the event the pen reservoir 24 is less than half-full with ink, and the pen 22 is tipped on its side as shown in FIG. 2, the reservoir ink 31 will no longer cover the orifice 54. In the absence of the sealing liquid 68, ambient air in the vent space 42 would readily flow through the passage 60 in the vent tube 58 and into the orifice 54, thereby eliminating any back pressure in the pen reservoir 24.

In accordance with the present invention, the sealing liquid 68 in the valve basin 34 flows against the inner surface 64 of the basin top 50 as the pen is tipped (FIG. 2), thereby to occlude the orifice 54. Moreover, the sealing liquid 68 flows across the inner end 62 of the vent tube 58 to occlude the passage 60 to prevent ambient air from passing through the tube into the chamber 56. Put another way, the sealing liquid provides two mechanisms (i.e., occluding the orifice 54 and occluding the passage 60) for ensuring that back pressure within the reservoir 24 is not lost by penetration of ambient air into the reservoir 24.

The sealing liquid is of a sufficient density, surface tension, or viscosity, or combination of density surface tension, and viscosity such that the sealing liquid 68 will not flow out of the basin chamber 56 through either the bubble generator orifice 54 or through the vent tube passage 60. For example, for a valve 20 that has a vent tube passage 60 of 0.51 mm or less, mercury will suffice as a sealing liquid 68. In this regard, the mercury will occlude the passage, but not migrate out of the basin 34 through the passage 60, even though the pen 22 is oriented so that the outer end 66 of the vent tube 58 is relatively lower than the inner end 62 of the vent tube 58 as the inner end 62 of that tube is immersed in the sealing fluid 68 (see FIGS. 2 and 4).

Other suitable material for use as sealing liquid are polybrominated high-density organic, such as acetylene tetrabromide, bromobenzene, and dibromobenzene. These just-listed materials, although having a lower density than mercury, have sufficient surface tension to prevent migration of the sealing liquid through the vent passage 60. Another such material suitable as sealing liquid 68 would be a fluoroalkylsiloxane, such as polymethy 1-3,3,3-tri-flouropropylsiloxane. It is contemplated that other material will suffice as sealing liquid, such as the silica gel-thickened chlorofluorocarbon lubricant sold by Petrarch Systems of Bristol, Pa., under the trade name Halocarbon.

It will be obvious to one of ordinary skill in the art that any of a number of liquids will suffice as sealing liquid. Generally, the sealing liquid should have a density greater than 1.4 grams per milliliter, or a surface tension greater than 10 dynes per centimeter and viscosity greater than 2000 centipoise.

The sealing liquid 68 is immiscible with and does not emulsify the ink carried in the pen. This feature prevents a sealing liquid/ink mixture from forming in or near a bubble generator orifice 54 or vent tube passage 60 in the event the pen is stored in an inverted position for a significant length of time. Such a mixture would tend to remain within the orifice 54 or passage 60 and, therefore, block the orifice 54 or passage 60 when the pen is returned to the upright position. Such a blocked orifice would interfere with the back pressure regulation provided by the orifice and vent. Put another way, the high density and immiscibility of the sealing liquid ensures that the sealing liquid will eventually flow out of the orifice 54 when the pen is returned to the upright position.

As shown in FIG. 3, whenever the pen 22 is completely inverted, the sealing liquid 68 moves against the inner surface 64 of the basin 34 to occlude the orifice 54 and passage 60. As mentioned above, the high surface tension or high density, or high viscosity of the sealing liquid 68 prevents the sealing liquid 68 from migrating through the orifice 54 and into the reservoir 28 while the pen 22 remains inverted.

Figure 4:
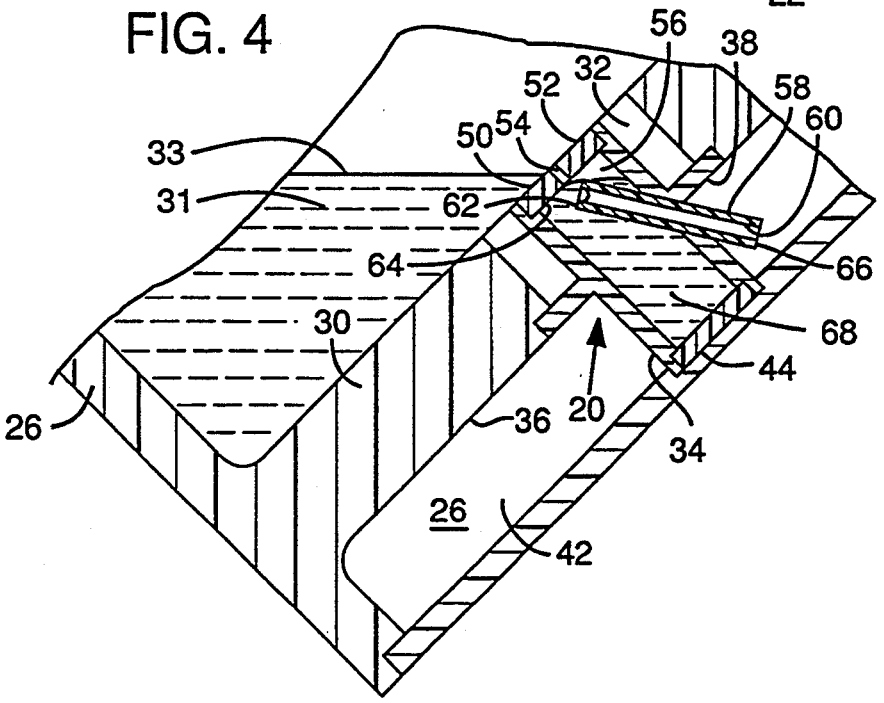
FIG. 4 depicts the pen and valve of FIG. 1 tipped out of the upright orientation.

Preferably, the surface 70 of the sealing liquid 68 is close to the inner end 62 of the vent tube 58 so that the passage 60 will be occluded as soon as the pen 22 is tipped by more than a slight angle out of the upright position shown in FIG. 1. This feature is particularly advantageous in instances where the reservoir ink 31 is nearly depleted, and the pen is tipped as shown in FIG. 4. In such an instance, the limited volume of reservoir ink 31 quickly flows to uncover the outer surface 52 of the basin top 50, thereby exposing the bubble generator orifice 54. The just-mentioned arrangement of the liquid 68 and inner end 62 of the passage 60, however, provides occlusion of the passage 60 before the reservoir ink uncovers the orifice 54. As a result, no ambient air from the vent space 42 is able to flow through the orifice.

Figure 5:
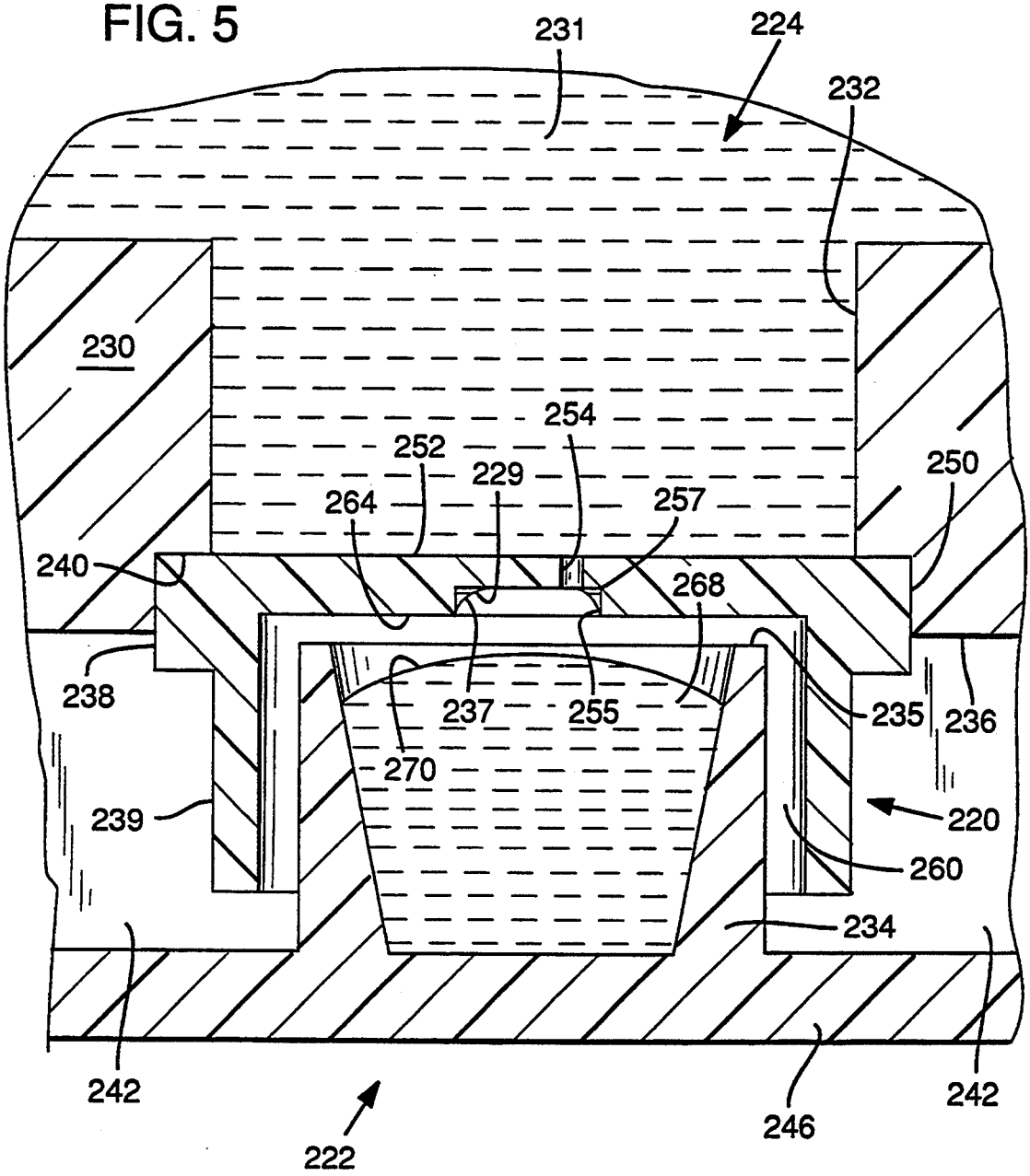
FIG. 5 is an enlarged side sectional view of a alternative embodiment of a valve formed in accordance with the present invention showing the valve with the pen in an upright position.
Figure 6:
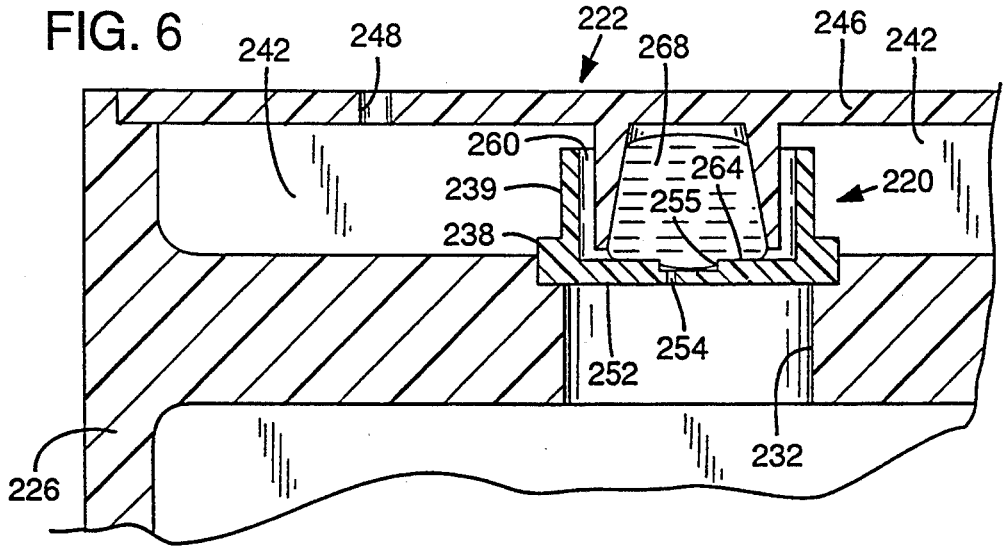
FIG. 6 depicts the valve of FIG. 5 in an inverted position.
Figure 7:
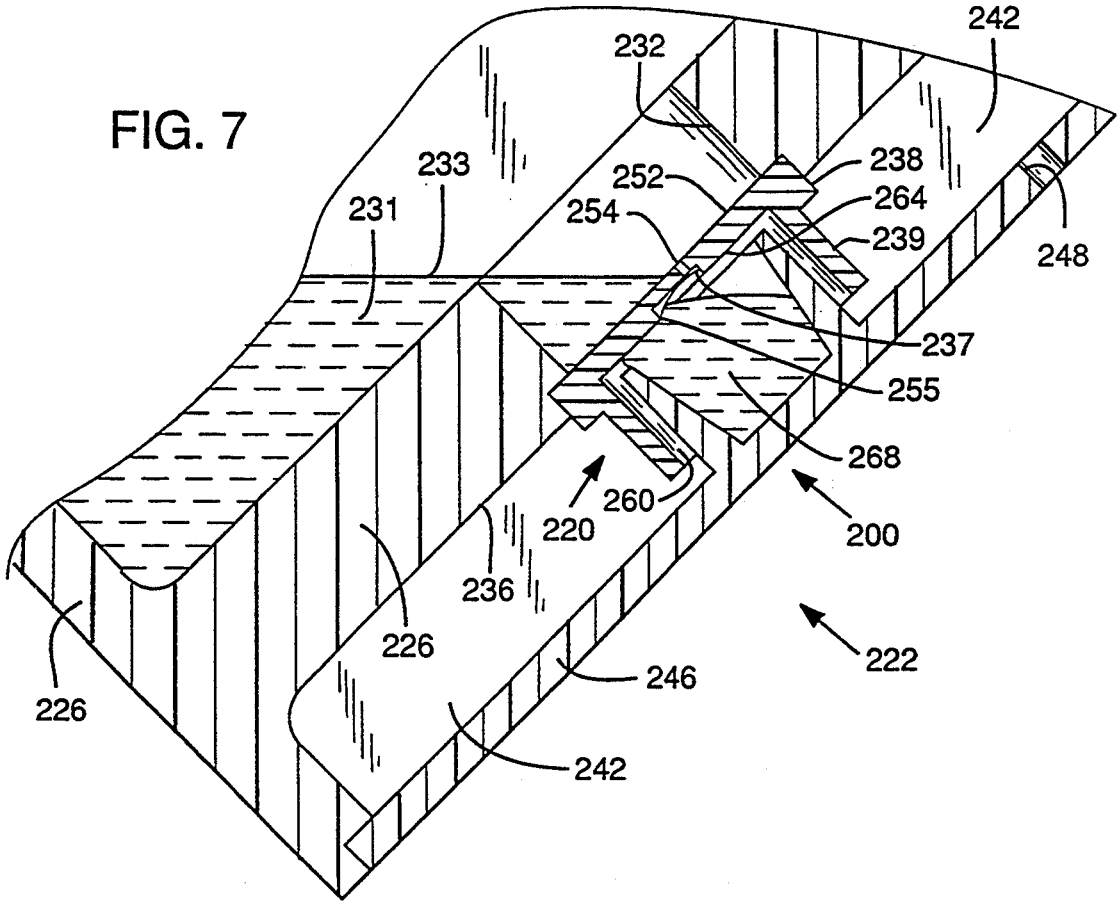
FIG. 7 depicts the valve of FIG. 5 tipped out of the upright position.

FIGS. 5–7 depict, in various orientations, an alternative embodiment of a valve 220 formed in accordance with the present invention. The valve 220 is connected to a pen 222 that includes, as does the earlier described pen 22, an ink reservoir 224 that is defined by side walls 226 and a top (not shown) and a base 230. The pen base includes a central opening 232, the lower end of which is substantially blocked by the valve 220.

More particularly, the valve 220 includes a basin cover 250 that has a generally flat circular top 238. The peripheral edge of the cover top 238 is fastened, such as by heat welding, into an annular recess 240 formed in the underside of the base 230 around the opening 232. An integrally formed, generally tubular side wall 239 extends downwardly (FIG. 5) from the top 238 to substantially surround an open-ended, generally cylindrical basin 234 that is formed with a bottom plate 246, which is plate 246 is attached to the bottom of the side walls 226 of the pen 222. The bottom plate 246 defines between it and the underside 236 of the base 230 a vent space 242 that is in fluid communication with ambient air via an aperture 248 formed through the bottom plate 246 (FIG. 6).

The basin 234 is substantially surrounded by, but spaced from, the tubular side wall 239 of the cover 250. The open top 235 of the basin 234 is near the inner surface 264 of the cover top 238. The space between the surface 264 and the basin 234 defines a passage 260 that extends between the inner surface 264 to the ambient air in the vent space 242.

A bubble generator orifice 254, functioning substantially identical to the bubble generator orifice 54 described earlier, is formed in the top 238 of the cover 250. The orifice 254 extends from the outer surface 252 of the top 238 to a location between the outer surface 252 and the inner surface 264 of the top 238. The lower end of the orifice 254 is contiguous with a counterbore 255 formed in the inner surface 264 of the cover top 238. The counterbore 255 traps a minute amount of either ink 237 or viscous sealing liquid 268, therein for occluding the orifice while the pen 222 is moved between an upright position (FIG. 5) to an inverted position (FIG. 6) as described more fully below.

The basin 234 carries sealing liquid 268, such as the sealing liquid 68 described in the embodiment depicted in FIG. 1. The surface 270 of the sealing liquid 268 is near the orifice 254, and when the pen is inverted (FIG. 6) the sealing liquid 268 moves into the counter bore 255 thereby occluding the orifice 254 (that is, while the outer surface 252 of the cover 250 is not covered with reservoir ink 237).

In addition to occluding the orifice 254, the sealing liquid 268 moves to occlude the passage 260 in the region immediately beneath the inverted basin 234. Preferably, the width of the passage 260 as measured from the top 235 of the basin to the inner surface 264 of cover top 238 is 0.3 mm or less. Consequently, the high surface tension of the sealing liquid 268, in combination with the reservoir back pressure that acts on the sealing liquid, keeps the sealing liquid 268 from flowing through the passage 260 toward the vent space 242 whenever the pen 222 is inverted (FIG. 6) or tipped as shown in FIG. 7. It will be appreciated by one of ordinary skill, that the combined high viscosity of the sealing liquid and the small diameter of the passage 260 will inhibit the flow of the sealing liquid 260 into the ink reservoir.

The counterbore 255 near the orifice 254 traps by capillarity a minute amount of ink 237 and/or sealing liquid 268 therewithin. The trapped ink 237 and/or sealing liquid 268 forms a meniscus, shown as 229 in FIG. 5 such that the volume of the trapped ink 233 is greatest near the inner corner 257 of the counterbore 255. Preferably, the diameter of the counterbore 255 is great enough (for example, greater than 1.2 mm) to hold a sufficient volume of ink 237 so that only a small amount of ink 237 or sealing liquid 268, is drawn out of the counterbore 255 into the reservoir 224 under the influence the normal operating back pressure within the reservoir 224. Moreover, the orifice 254 and counterbore 255 are eccentric such that the orifice 254 is near the corner 257 of the counterbore 255 so that a relatively large volume of ink 237 or sealing liquid 268, is trapped immediately adjacent to (FIG. 5) the orifice 254 to perform a supplementary occluding effect as described next.

The trapped ink 237 in the counterbore 255 serves to attract ink present on the surface of the higher density sealing fluid 268, as the pen is moved between an upright position (FIG. 5) and an inverted position (FIG. 6). Since surface energies are minimized by the coalescence of the trapped ink and the ink on the sealing fluid, a single ink drop is immediately formed. This drop occludes all passages and re-forms a meniscal seal. The preferred higher viscosity and density of the sealing liquid augment this effect.

FIG. 7 depicts the pen 222, having a relatively small amount of reservoir ink 231, as the pen is moved from the upright position to an inverted position. The configuration of the basin 234 is such that the sealing liquid 268 will not move to completely occlude the orifice 254 until the pen 222 is tipped substantially farther (than shown in FIG. 7) out of the upright position. With a relatively small amount of reservoir ink 231, however, the outer surface 252 of the cover top 238 near the orifice 254 is uncovered before the orifice is occluded by the sealing liquid 68 (see FIG. 7). The trapped ink 237 in the counterbore 255, however, effectively seals the orifice 254 by forming a thin film meniscus, until the pen reaches a position (such as tipped 90° out of the upright position) where the sealing liquid 268 will occlude both the orifice 254 and the passage 260.

It will be appreciated by one of ordinary skill that the trapped ink 237 also serves to occlude the orifice 254 as the pen is moved from an inverted to an upright position during the interval that neither the sealing liquid 268 nor the reservoir fluid 231 covers the orifice 254.

As noted, the liquid 237 trapped in the counterbore 255 to form the thin film meniscus may be ink. The sealing liquid also forms the above described thin film meniscus, although more slowly, due to its higher viscosity.

Figure 8:
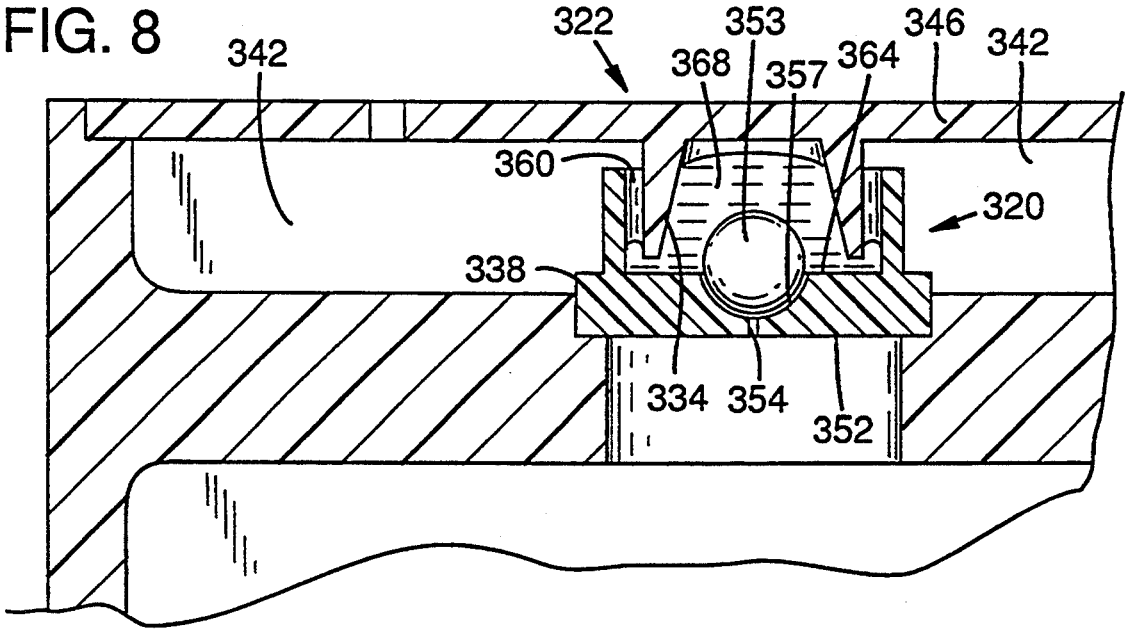
FIG. 8 depicts an alternative embodiment of a valve of the present invention showing the valve in an inverted position.

FIG. 8 depicts an alternative embodiment of a valve 320 of the present invention, shown in an inverted orientation. The embodiment depicted in FIG. 8 is modified over that in FIGS. 5–7 to the extent that a blocking ball 353 is contained within the basin 334 substantially immersed in the sealing liquid 368. The cover top 338 includes a curved recess 357 formed within the inner surface 364 of the top. The recess 364 conforms to the shape of the ball 353. An orifice 354 extends from the outer surface 352 of the top 338 to be contiguous with the recess 357.

The ball 353 has a density greater than that of the sealing liquid 368 and, therefore, whenever the valve is inverted as shown in FIG. 8, the ball 353 seats within the recess 357 to occlude the orifice 354. As the pen 322 is returned to the upright position, the blocking ball 353 moves downwardly toward the bottom plate 346 of the pen so that fluid communication is restored between the reservoir and the vent space 342 via the passage 360.

Preferably, the blocking ball 353 has sufficient density so that when the pen 322 is returned to the upright position the rapid motion of the ball through the sealing liquid 368 toward the bottom plate 346 will draw sealing liquid from the passage 360 and into the temporary void left by the ball, thereby reliably opening the passage 360 for reestablishing fluid communication as just mentioned.

The blocking ball 353 preferably comprises a high-density core that is coated with a bonding layer. The bonding layer bonds with the sealing liquid 368 so that a thin layer of sealing liquid is at all times retained around the periphery of the ball 353 for ensuring an effective fluid seal of the orifice 354. The bonding layer may be a soft resin, such as available from General Electric Co. as trade designation TPR 178/179. The resin may contain mercapto-propyl, or amino-propyl functional groups. Such a coated ball is best used with a sealing liquid comprising a polyfluoroalkylsiloxane, such as available from Petrarch Systems as PS 182 or PS 183.

The ball 353, coated as it is with a bonding layer, is effective for drawing sealing liquid 368 from the vent passage 360, orifice 354, and recess 357 when the pen 322 is returned to the upright position. As noted earlier, it is desirable to effectively remove the sealing liquid 368 from the passage 360 for the purpose of restoring fluid communication between the pen reservoir and the vent space 342.

While having described and illustrated the principles of the invention with reference to preferred embodiments and alternatives, it should be apparent that the invention can be further modified in arrangement and detail without departing from such principles. Accordingly, it is understood that the present invention includes all such modifications that may come within the scope and spirit of the following claims and equivalents thereof.

We claim:

1. A valve apparatus, comprising:

a container constructed for storing a first liquid and for maintaining a back pressure therein, the container being configured with an orifice extending therethrough, the orifice being sealed with the first liquid whenever the container is in a first position;

a basin connected to the container and located near the orifice; and sealing liquid permanently stored within the basin and spaced from the orifice when the container is in the first position, the basin being arranged for the sealing liquid to flow against and seal the orifice after the container is moved out of the first position.

2. The apparatus of claim 1 further comprising vent means defining a passage extending between the orifice and ambient air surrounding the basin, the passage permitting the ambient air to pass through the orifice and into the container whenever the back pressure within the container rises above a first back pressure.

3. The apparatus of claim 2 wherein the container is movable out of the first position so that the orifice is no longer sealed by the first liquid and wherein the basin and sealing liquid are arranged so that the sealing liquid moves to occlude the passage whenever the container is moved out of the first position.

4. The apparatus of claim 1 wherein the sealing liquid has a surface tension greater than 10 dynes per centimeter.

5. The apparatus of claim 1 wherein the sealing liquid has a density greater than 1.4 grams per milliliter.

6. The apparatus of claim 1 wherein the sealing liquid is immiscible with the first liquid.

7. A valve apparatus, comprising:

a container constructed for storing a first liquid and for maintaining a back pressure within the container, the container being positionable in a first position;

a basin connected to the container and permanently carrying a sealing liquid therein, the apparatus constructed to have an orifice for providing fluid communication between the container and the basin; and a vent connected to the apparatus for defining a passage that provides fluid communication between the basin and ambient air surrounding the basin, the sealing liquid being spaced from the passage when the container is in the first position and moving to occlude the passage after the container is moved out of the first position.

8. The apparatus of claim 7 wherein the vent comprises a tube having an inner end within the basin and an outer end out of the basin.

9. The apparatus of claim 8 wherein the basin is arranged so that the sealing liquid moves to occlude the inner end of the tube and occlude the orifice after the container is moved out of the first position.

10. The apparatus of claim 9 wherein the sealing liquid has a surface tension greater than 10 dynes per centimeter.

11. The apparatus of claim 9 wherein the sealing liquid has a density greater than 1.4 grams per milliliter.

12. The apparatus of claim 7 wherein the vent includes a cover connected to the container and covering part of the basin, the cover being spaced from the covered part of the basin thereby defining the passage between the basin and the cover.

13. The apparatus of claim 12 wherein the sealing liquid has a surface tension greater than 10 dynes per centimeter.

14. The apparatus of claim 12 wherein the sealing liquid has a density greater than 1.4 grams per milliliter.

15. The apparatus of claim 12 wherein the orifice extends through the cover and has a first diameter portion opening into the container and a second diameter portion opening into the passage, the diameter of the second diameter portion being larger than the diameter of the first diameter portion.

16. The apparatus of claim 15 wherein the first and second diameter portions are eccentric.

17. The apparatus of claim 7 wherein the sealing liquid has a surface tension greater than 10 dynes per centimeter.

18. The apparatus of claim 7 wherein the sealing liquid has a density greater than 1.4 grams per milliliter.

19. The apparatus of claim 7 wherein the sealing liquid has a viscosity greater than 2000 centipoise.

20. The apparatus of claim 7 further comprising:

a seal member having a density greater than the density of the sealing liquid and carried in the sealing liquid, the seal member being movable to occlude the orifice whenever the container is inverted from the first position.

21. The apparatus of claim 20 wherein the seal member includes a core portion and a coating portion that covers the core portion, the coating portion being bondable with the sealing liquid.

22. A method for sealing an orifice that extends through a container that contains a first liquid that covers the orifice when the container is in an upright position, the method comprising the step of permanently storing beneath and spaced from the orifice a sealing liquid that moves against and seals the orifice after the container is moved out of an upright position.

23. The method of claim 22 further comprising the steps of:

configuring a passage for permitting ambient air to pass through the orifice and into the container; and arranging the sealing liquid so that the sealing liquid moves to occlude the passage whenever the container is moved out of the upright position.

24. The method of claim 23 further comprising the step of selecting the sealing liquid to have a surface tension sufficient for preventing the sealing liquid from flowing out of the occluded passage.

* * * * *